United States Patent [19]

Kaufhold

[11] Patent Number: 5,002,192

[45] Date of Patent: Mar. 26, 1991

[54] BEARING ARRANGEMENT FOR RAILWAY DRAWBAR CONNECTION

[75] Inventor: Horst T. Kaufhold, Chicago, Ill.

[73] Assignee: AMSTED Industries Incorporated, Chicago, Ill.

[21] Appl. No.: 485,641

[22] Filed: Feb. 27, 1990

[51] Int. Cl.[5] ..... B61G 7/10

[52] U.S. Cl. ..... 213/61; 213/50.5

[58] Field of Search ..... 213/10, 50, 50.5, 51, 213/54, 60, 61

[56] References Cited

U.S. PATENT DOCUMENTS

| | | | |
|---|---|---|---|
| 1,517,635 | 12/1924 | Kadel et al. | 213/50 |
| 1,549,988 | 8/1925 | Kadel et al. | 213/50 |
| 3,240,353 | 3/1966 | Williams | 213/61 X |
| 3,987,907 | 10/1976 | Larsen | 213/61 |
| 4,078,669 | 3/1978 | Peterson et al. | 213/50.5 |
| 4,555,033 | 11/1985 | Miller | 213/54 X |
| 4,589,558 | 5/1986 | Brodeur et al. | 213/50 X |
| 4,700,853 | 10/1987 | Altherr et al. | 213/50 |

*Primary Examiner*—Robert J. Oberleitner
*Assistant Examiner*—S. Morano
*Attorney, Agent, or Firm*—Edward J. Brosius; Charles E. Bouton

[57] ABSTRACT

An improved center sill construction is provided having sill side castings for laterally positioning and holding a drawbar evenly within a center sill, the sill side castings being easily removable without substantial damage to the center sill. The sill side castings are open ended in the direction of the draft loads and center sill reinforcement means are provided to accept the longitudinal draft load of the drawbar. Thus, the heavy loads are eliminated from upon the sill side castings and the sill side castings may be adequately secured within the center sill by a light weld which is external to the center sill.

11 Claims, 6 Drawing Sheets

BEARING ARRANGEMENT FOR RAILWAY DRAWBAR CONNECTION

BACKGROUND OF THE INVENTION

The present invention relates to railway coupler connections and more particularly to an improved draft key bearing arrangement for a slackless coupler member in which the longitudinal draft loads of the coupler member are substantially eliminated from the sill side castings of the draft key bearing arrangement allowing for external attachment and easy removal of the sill side castings.

Railway cars are connected together by coupler members, namely drawbars or couplers. Drawbars are integral units known to be used in the railroad industry to extend between and permanently connect two or more railway cars. Couplers are independent units on each car which interconnect with one another, between adjacent cars, to form a connection. In either instance, a shank end of the drawbar or coupler extends into the center sill of a railway car where it is secured to transmit longitudinal loads to the car.

One type of drawbar is currently positioned and held within the center sill of a railway car by the combination of a draft key inserted through a pair of sill side castings. Such an arrangement is shown in Altherr et al., U.S. Pat. No. 4,700,853 wherein the sill side castings have inward projections to center the drawbar within the center sill. In addition to laterally positioning and holding the drawbar, the sill side castings have also fully encircled the draft key so as to transfer the longitudinal loads, particularly the draft load, of the drawbar from the draft key to the center sill. A direct transfer of the longitudinal loads from the draft key to the center sill has not been practical as the center sill side walls do not have the cross-sectional area necessary to accept these loads from the draft key without fatigue or failure.

It is advantageous to railroad owners to have railway cars which can be converted from a drawbar arrangement to a coupler arrangement. However, the inward projections of the sill side castings are not compatible with coupler shanks. Furthermore, these sill side castings are subject to in-service wear and must therefore be replaced. This makes removal of the sill side castings desirable.

However, it has heretofore been necessary that the sill side castings be rigidly secured (heavily welded) to the inside of the center sill so as to withstand the longitudinal draft loads of the drawbar. Accordingly, the only way to remove the sill side castings has been to burn off the heavy welding on the inside of the center sill. Burning off this heavy weld is extremely difficult and often causes damage to a portion of the center sill side wall which must be restored or replaced. This procedure is costly and time consuming.

SUMMARY OF THE INVENTION

Accordingly, it is an object of the present invention to provide an improved sill side casting for laterally positioning and holding a drawbar evenly within a center sill which is removable without causing substantial damage to the center sill.

It is another object of the present invention to provide a sill side casting for a slackless railway coupler connection which is substantially free from the longitudinal loads of the drawbar.

By the present invention, it is proposed to overcome the difficulties encountered heretofore. To this end, it has been discovered that the elimination of the longitudinal loads upon the sill side castings allows for a simple means of attachment of the sill side castings within the center sill which is completely external. The center sill is provided with reinforcement means which add the cross-sectional area necessary to accept the longitudinal draft loads of the drawbar without fatigue or failure. At the same time, the sill side casting is provided with an open slot for receiving the draft key which allows the longitudinal draft loads to be transferred directly to the center sill reinforcement means. External attachment means make the sill side casting easily removable for replacement or for conversion of a railway car from a drawbar arrangement to a coupler arrangement. The invention can be applied to either specially designed cars with built-in center sill reinforcement means or to standard cars which are of the current design.

DETAILED DESCRIPTION OF THE INVENTION

Figure 1:
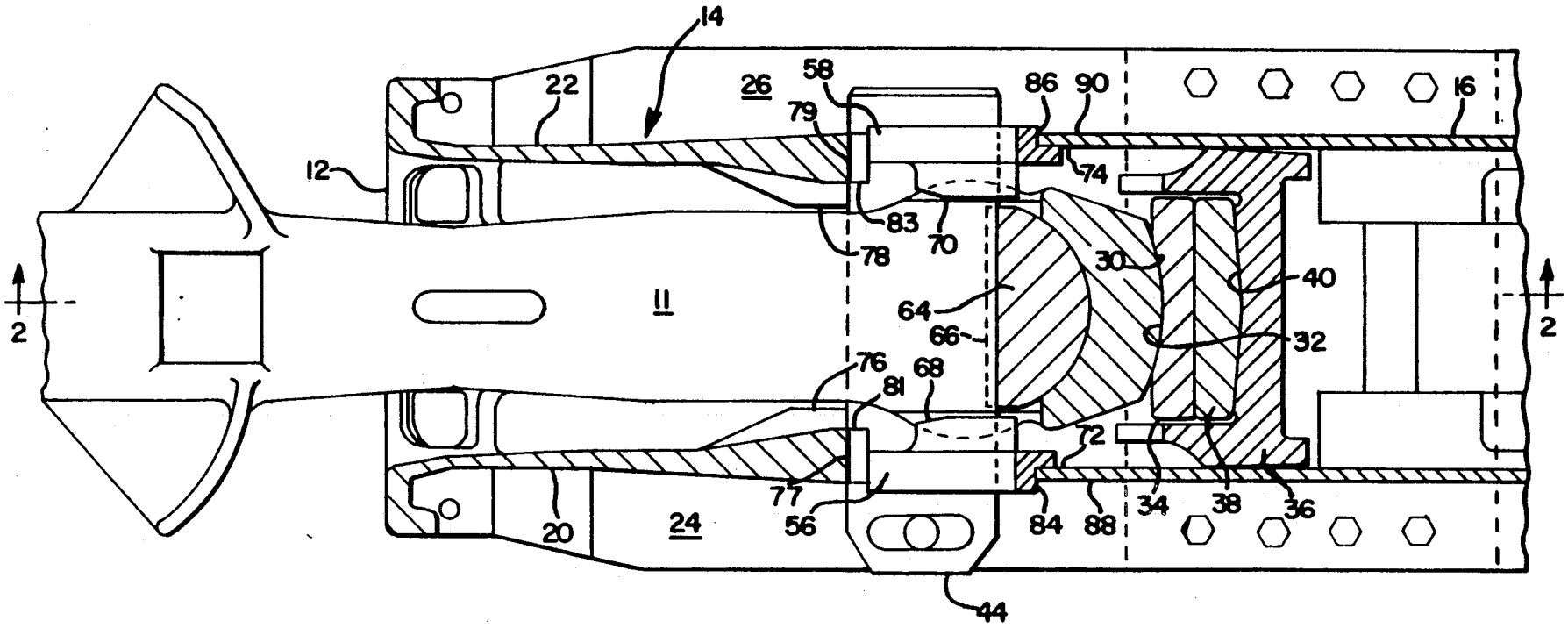
FIG. 1 is a sectional plan view of a preferred embodiment of the invention.
Figure 2:
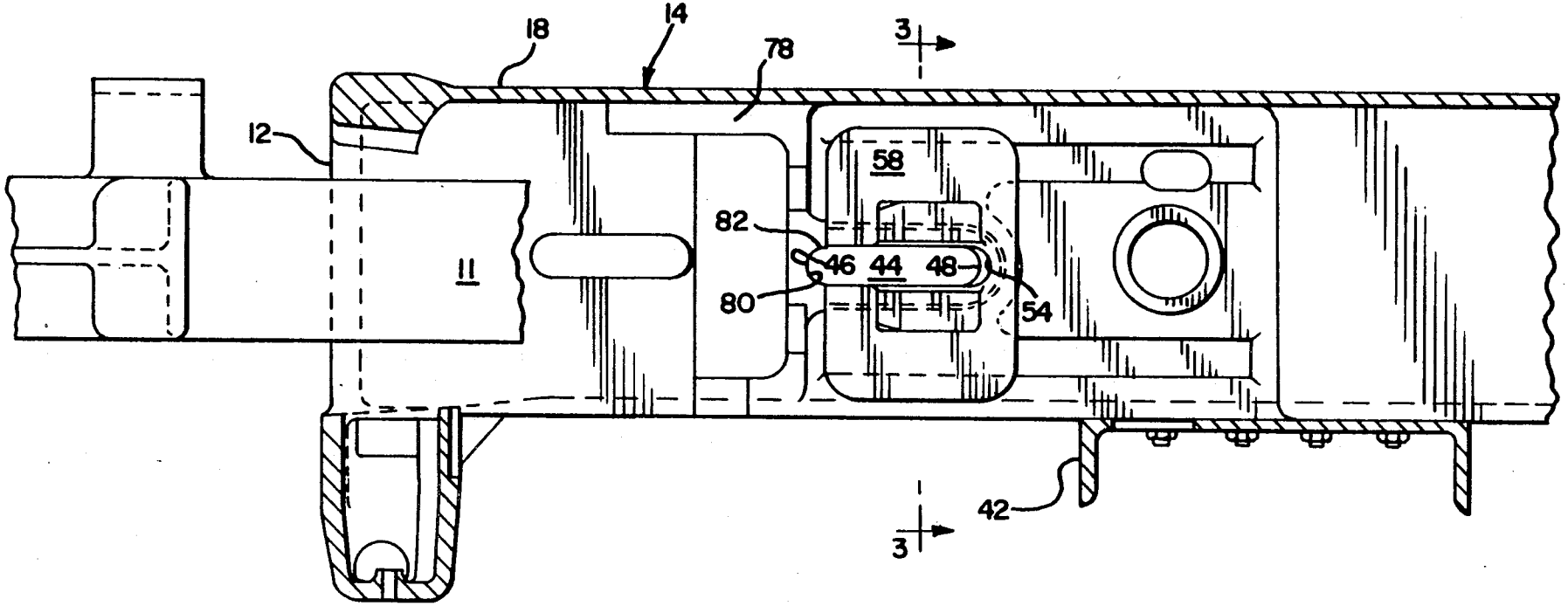
FIG. 2 is a side elevation of the apparatus, partially in section taken along lines 2—2 of FIG. 1 with certain parts broken away for clarity.
Figure 3:
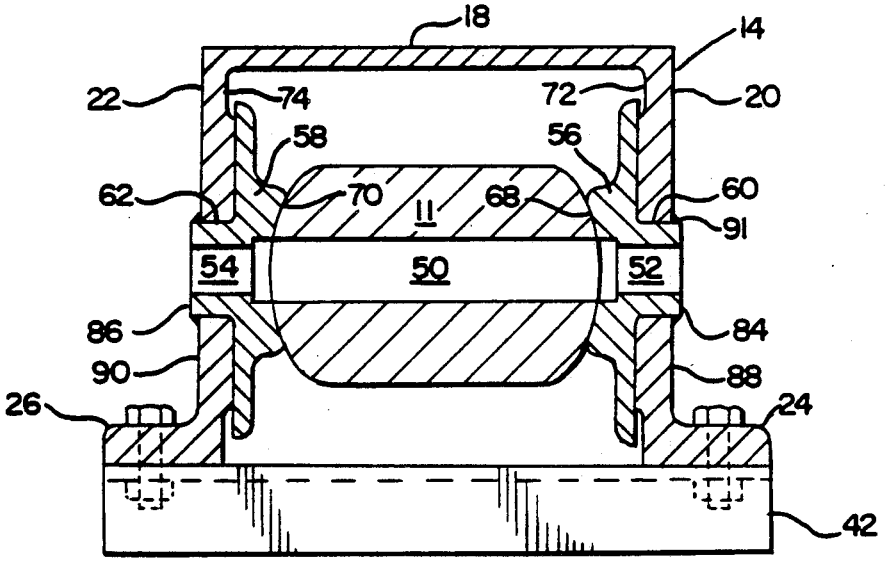
FIG. 3 is a sectional end elevation of the apparatus taken along lines 3—3 of FIG. 2 again with certain parts broken away for clarity.

In FIGS. 1-3, one end of a slackless coupler member such as a drawbar embodying the improved design of the present invention is shown generally at 11. The drawbar 11 extends within an open end 12 of a center sill, generally 14, which is secured longitudinally beneath a railway car (not shown). The center sill 14 is of a standard construction comprising an inverted U-shaped channel member 16 having top wall 18, side walls 20 and 22 and outturned flanges 24 and 26 at the lower open bottom.

A convex butt end 30 of drawbar 11 fits against a matching concave face 32 of a follower block 34 which is held within a pocket casting 36. A vertically tapered wedge 38 is located between the follower block 34 and pocket casting 36, rear wall 40 to remove slack. The pocket casting 36 is mounted cross-wise within the center sill channel member 16 upon a support channel 42 which is fastened to the sill flanges 24 and 26.

The drawbar 11 is held within the center sill 14 by a draft key 44, having rounded edges 46 and 48, which is extended horizontally through a slot 50 in the drawbar 11 and through slots 52 and 54 in sill side castings 56 and 58 which are mounted inside the center sill side walls 20 and 22 and which partially pass through openings 60 and 62 provided in the center sill side walls 20 and 22 respectively. The drawbar slot 50 is arched toward the convex butt end 30 and retains therein a correspondingly contoured arcuate key bearing block 64 which has a concave straight side 66 adapted to receive a convex edge 48 of the draft key 44. The slot 50 in the drawbar 11 diverges vertically opposite the drawbar end 30. The aforementioned arrangement of draft key 44, key bearing block 64, and slots 50, 52 and 54 permits vertical and horizontal angling movement of the drawbar 11 within the center sill 14 from the concave follower block 34.

Sill side castings 56 and 58 are provided with guide lugs 68 and 70 which act to laterally position and hold the drawbar 11 evenly within the center sill 14. Furthermore, the sill side castings 56 and 58 of the prior art transfer the longitudinal loads of the drawbar 11 from the draft key 44 to the center sill side walls 20 and 22. A direct transfer of the drawbar longitudinal loads from the draft key 44 to the center sill side walls 20 and 22 is not practical in the prior art as the side walls 20 and 22 are too thin and can fail under such loads. The sill side castings 56 and 58 thus provide the sectional area necessary to accept and transfer these longitudinal loads. A problem with this configuration is that, in order to accept and transfer the longitudinal loads of the drawbar 11 to the center sill 14, the sill side castings 56 and 58 have to be rigidly secured (heavily welded) to the inner surfaces 72 and 74 of the center sill side walls 20 and 22 respectively making removal of the sill side castings 56 and 58 extremely difficult without causing substantial damage to the center sill side walls 20 and 22.

According to the present invention, the longitudinal draft loads of the drawbar 11 are substantially eliminated from upon the sill side castings 56 and 58 by opening the draft end 82 of the key slots 52 and 54 of the sill side castings 56 and 58 and providing center sill reinforcement means that accept and transfer the longitudinal draft loads from the draft key 44 to the center sill side walls 20 and 22. It is important that the center sill reinforcement means have a sufficiently large cross-sectional area so as not to fail under the full draft loads. In this way the sill side castings 56 and 58 function largely to laterally position the drawbar 11 and are releasably secured to the center sill side walls 20 and 22 by the minimal welding described hereafter. It is also convenient that the center sill reinforcement means be shaped to contact the rounded draft-side edge 46 of the draft key 44 in an arcuate manner so as to provide for a greater bearing area than can be provided by linear contact. At the same time, it is important that external attachment means be used to completely secure the sill side castings 56 and 58 within the center sill 14 in order to provide for easy removal of the sill side castings 56 and 58.

The preferred form of the center sill reinforcement means include striker members 76 and 78 which are cast integral with or rigidly secured to the center sill 14. The striker members 76 and 78 are located proximate to the inner surfaces 72 and 74 of the center sill side walls 20 and 22 respectively and extend longitudinally to a position which is proximate to the sill side castings 56 and 58 at which point the striker members 76 and 78 include vertical rib portions 77 and 79, respectively. The striker members 76 and 78 gradually increase in thickness, each having its greatest cross-sectional area at its vertical ribs 77 and 79.

The vertical ribs 77 and 79 of the striker members 76 and 78 include reinforced projecting surfaces 81 and 83, each of which includes an arcuate recess 80 to receive the rounded draft edge 46 of the draft key 44. It is this rounded draft edge 46 of the draft key 44 which transfers the draft load to the center sill 14 during pulling of the railway car.

The arcuate recess 80 in the projecting surface 83 of the vertical rib 79 is in alignment with and adjacent to the open end 82 of the slot 54 in the sill side casting 58 as shown in FIG. 2. An identical arrangement exists between the striker member 76 and the sill side casting 56 (not shown). This allows for the longitudinal draft loads of the drawbar 11 to bypass the sill side castings 56 and 58 and pass directly into the striker members 76 and 78 for eventual transfer to the center sill 14.

The arcuate recess 80 allows for a greater surface contact and therefore a greater bearing area between the draft key 44 and the reinforced projecting surfaces 81 and 83 of the striker member vertical ribs 77 and 79 than if the draft key 44 abutted a vertical striker member as in a standard center sill construction. If the edge 46 of the draft key 44 would abut a vertical surface, there would merely be linear contact between the two surfaces. Furthermore, the increased cross-sectional area created by the combination of the center sill side walls 20 and 22 and the striker members 76 and 78 is adequate enough to carry the longitudinal draft loads of the drawbar along the center sill 14 without fatigue or failure.

By transferring the longitudinal draft loads of the drawbar 11 directly from the draft key 44 to the center sill reinforcement means such as the projecting surfaces 81 and 83 of the striker member vertical ribs 77 and 79, the longitudinal draft loads of the drawbar 11 are thus substantially eliminated from the sill side castings 56 and 58. Accordingly, there is no longer any need to heavily weld the sill side castings 56 and 58 to the inner surfaces 72 and 74 of the center sill side walls 20 and 22 respectively. The sill side castings 56 and 58 may now be adequately secured to the center sill side walls 20 and 22 with external attachment means.

The preferred form of the external attachment means comprises a weld between the outer peripheries of the projecting portions 84 and 86 of the sill side castings 56 and 58 respectively and the corresponding outer surfaces 88 and 90 of the center sill side walls 20 and 22 respectively. Such a weld secures the sill side castings 56 and 58 to the center sill side walls 20 and 22 adequately enough to laterally position and hold drawbar 11 evenly within center sill 14. Furthermore, such a weld may be easily removed externally in order to remove the sill side castings 56 and 58 from the center sill 14.

Several variations of weld attachment between the sill side castings and the center sill side walls are possible with the preferred form being shown in FIG. 3 in which a fillet-type weld 91 is shown.

Figure 4:
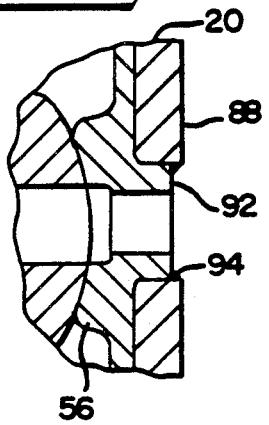
FIG. 4 is a partial detail view in section of an alternative embodiment of the invention.

In FIG. 4, an alternative form of attachment is shown in which a projecting portion 92 of the sill side casting 56 is recessed within the outer surface 88 of the center sill side wall 20 and a fillet-type weld 94 is used.

Figure 5:
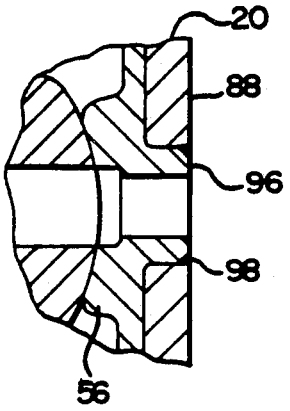
FIG. 5 is a partial detail view in section of another alternative embodiment of the invention.

In FIG. 5, another alternative form of attachment is shown in which a projecting portion 96 of the sill side casting 56 is flush with the outer surface 88 of the center sill side wall 20. The projecting portion 96 of the sill side casting 56 is chamfered about its outer periphery in order that a groove-type weld 98 may be used.

Figure 6:
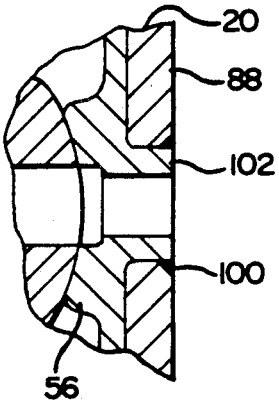
FIG. 6 is a partial detail view in section of yet another alternative embodiment of the invention.
Figure 7:
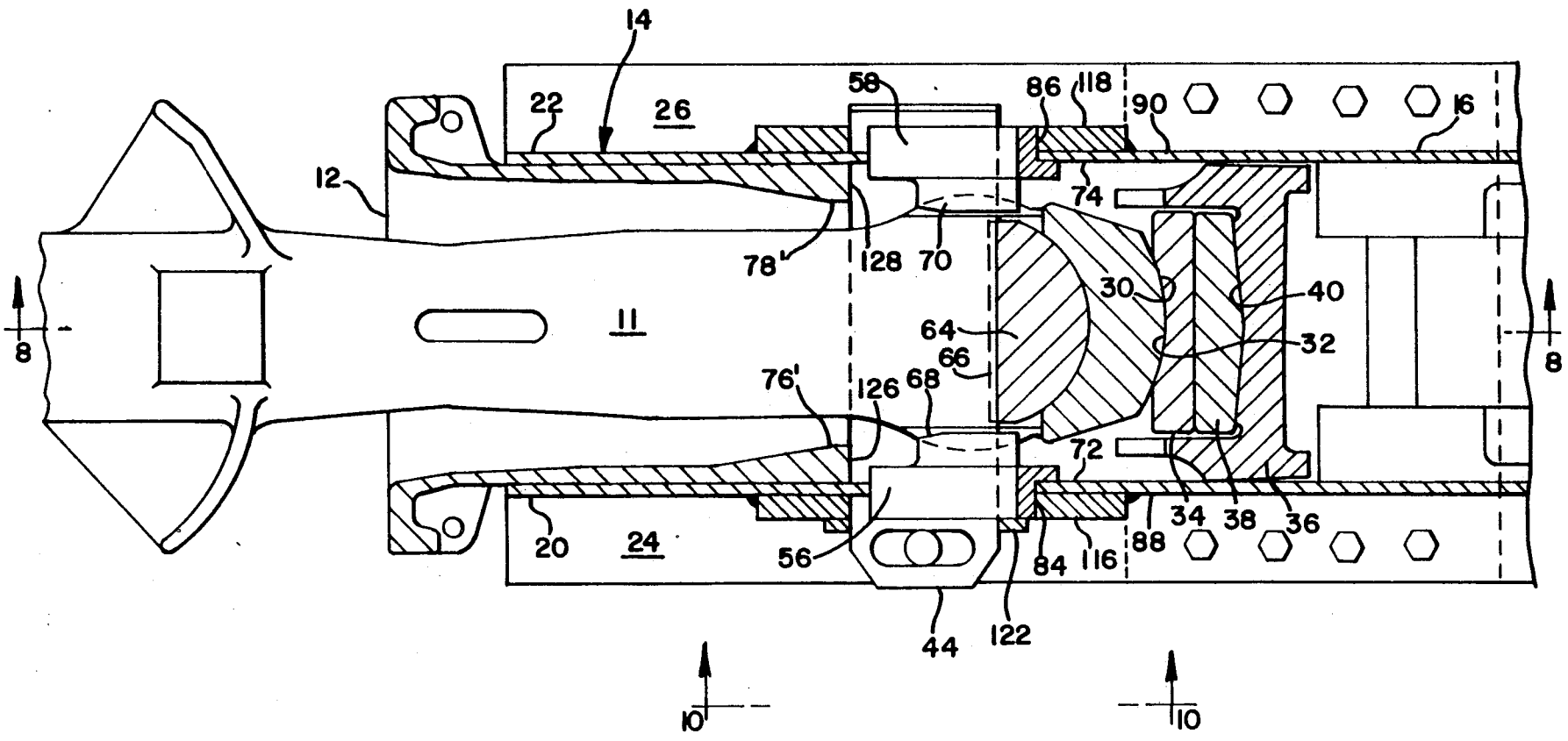
FIG. 7 is a sectional plan view of still another embodiment of the invention.
Figure 8:
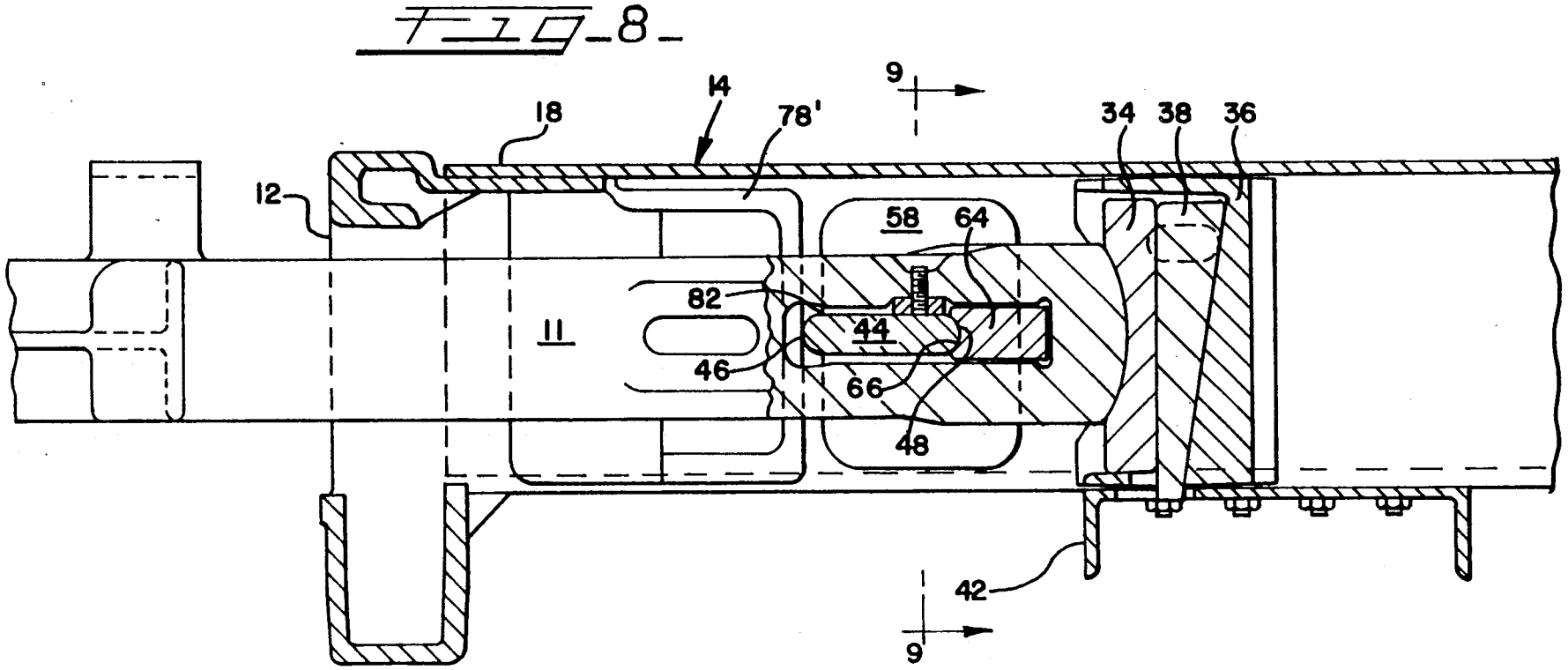
FIG. 8 is a side elevation of the apparatus, partially in section, taken along lines 8—8 of FIG. 7.
Figure 9:
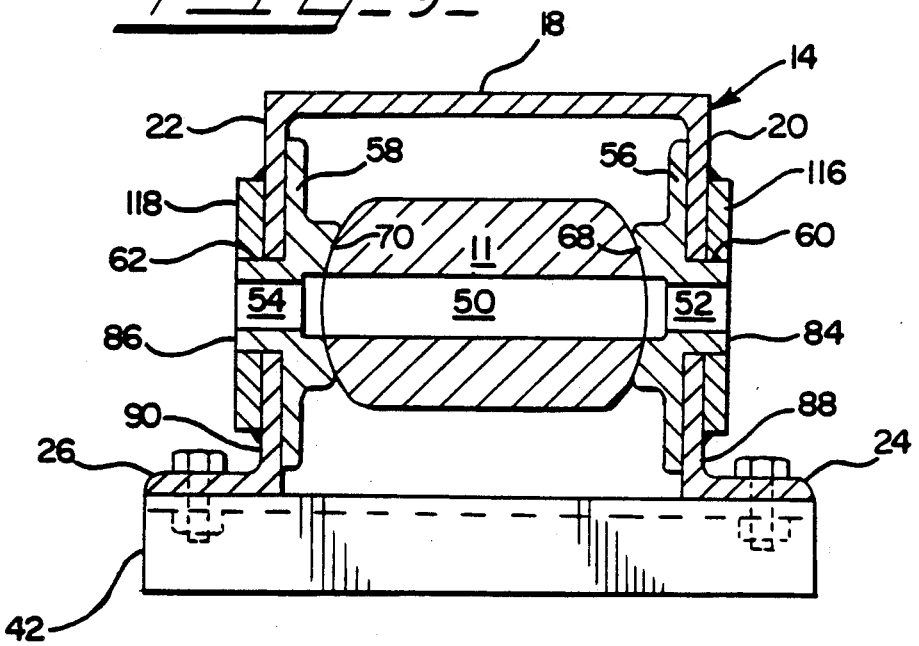
FIG. 9 is a sectional end elevation of the apparatus taken along lines 9—9 of FIG. 8 with certain parts broken away for clarity.
Figure 10:
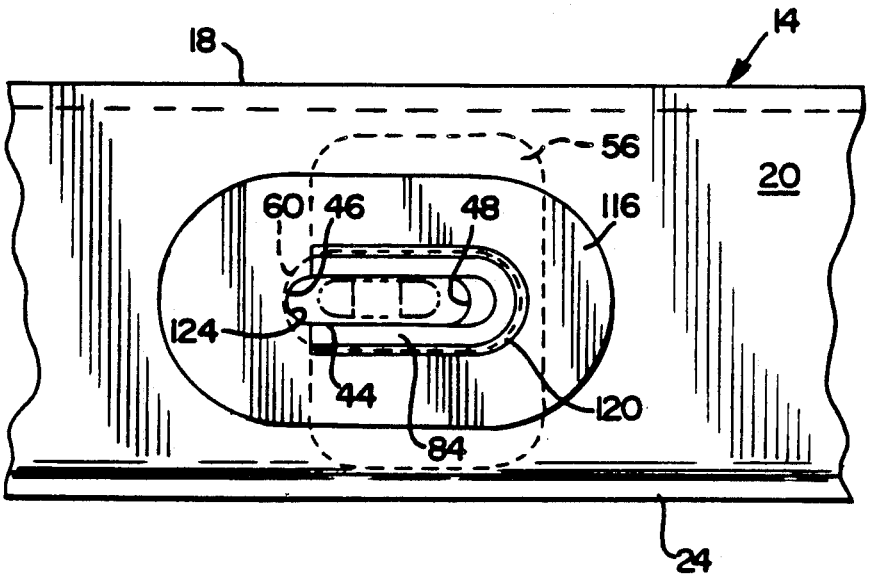
FIG. 10 is a partial side elevation of the apparatus taken along lines 10—10 of FIG. 7.

In FIG. 6, yet another alternative form of attachment is shown in which the outer surface 88 of the center sill side wall 20 is chamfered so that a groove-type weld 100 may be used with a projecting portion 102 of the sill side casting 56. Of course, it would also be possible to chamfer both the projecting portion of the sill side casting 56 and the outer surface 88 of the center sill side wall 20.

Another form of the center sill reinforcement means which may be applied to a prior art truck without the special designed striker members 76 and 78 of FIGS. 1 and 2 is shown in FIGS. 7–10 with similar parts shown with identical numbers. In this embodiment, the center sill reinforcement means include exterior reinforcement plates 116 and 118, each of which is welded about its outer periphery to the corresponding outer surface 88 and 90 of the center sill side walls 20 and 22 respectively. Each of the reinforcement plates contain an aperture 120 through which the draft key 44 and the projecting portions 84 and 86 of the sill side castings 56 and 58 are received. A shim 122 (shown only in FIG. 7) may be included to ensure a tight lateral fit of the draft key 44 within the arrangement.

Each of the apertures 120 is shaped to correspond to the outer periphery of the projecting portions 84 and 86 of the sill side castings 56 and 58. Each of the reinforcement plate apertures include a corresponding arcuate recess 124 in alignment with and adjacent to the open ends 82 of the slots 52 and 54 of the sill side castings 56 and 58. The arcuate recess 124 of each of the reinforcement plates 116 and 118 receives the rounded edge 46 of the draft key 44. It is this rounded edge 46 of the draft key 44 along which the longitudinal draft load of the drawbar 11 is transferred to the reinforcement plates 116 and 118.

The arcuate recess 124 in each of the reinforcement plates 116 and 118 is additionally aligned with striker flange side walls 76' and 78' which have vertical surfaces 126 and 128 in abutment to the rounded edge 46 of the draft key 44. These areas of contact are linear but nevertheless transfer a portion of the longitudinal draft loads of the drawbar 11 to the center sill 14.

Again, the arcuate recess 124 in each of the reinforcement plates 116 and 118 allows for a greater bearing area between the draft key and the reinforcement plates 116 and 118 and thus a greater share of the longitudinal loads of the drawbar 11 are transferred to the center sill 14 through these reinforcement plates 116 and 118. In addition, the reinforcement plates 116 and 118 add the increased cross-sectional area required for the center sill side walls 20 and 22 to carry the longitudinal loads of the drawbar along the center sill 14 without fatigue or failure.

Since the slots 52 and 54 in the sill side castings 56 and 58 are open ended at the location where the rounded edge 46 of the draft key 44 is received in the arcuate recesses 120 of the reinforcement plates 116 and 118, the longitudinal loads of the drawbar 11 bypass the sill side castings 56 and 58 and pass directly into the reinforcement plates 116 and 118 as well as the striker flange side walls 76' and 78' for transfer to the center sill 14.

As discussed heretofore, this load bypassing of the sill side castings 56 and 58 eliminates the need for rigid weld securement between the sill side castings 56 and 58 and the inner surfaces 72 and 74 of the center sill side walls 20 and 22. External attachment means can now be used to secure the sill side castings 56 and 58 within the center sill.

The preferred form of external attachment means in this embodiment comprises a weld between the outer peripheries of the projecting portions 84 and 86 of the sill side castings 56 and 58 and the corresponding outer periphery of each of the apertures 120 in the reinforcement plate 116 and 118. This weld attachment will provide the securement necessary for the sill side castings 56 and 58 to laterally position and hold drawbar 11 evenly within center sill 14. In addition, such a weld may be easily removed externally in order to remove the sill side castings 56 and 58 from the center sill.

The foregoing description and drawings explain and illustrate the best known modes of the invention and those skilled in the art who have the disclosure before them will be able to make modifications and variations therein without departing from the scope of the invention which is defined in the following claims:

What is claimed is:

1. An improved center sill construction for a railway car of the type having a coupler member extending into a railway car center sill, sill side castings for positioning and holding said coupler member within said center sill, and a draft key extending horizontally through slots in said coupler member, said sill side castings and said center sill, the improvement in which: said slots in said sill side castings are open in the direction of the draft loads from said coupler members; said center sill includes openings to receive a portion of said sill side castings; and said center sill includes reinforcement means at the open end of said slots in said sill side castings, said center sill reinforcement means comprising striker members which are cast integral with said center sill, each of said striker members located proximate to the inside of respective side walls of said center sill on opposite sides of said coupler member, each of said striker members including an arcuate recess for receiving a corresponding shaped edge of said draft key, thereby transferring the longitudinal draft loads of said coupler member from said draft key to said center sill.

2. The invention according to claim 1 in which external attachment means are located on the outside of said center sill for completely securing said sill side castings within said center sill.

3. The invention according to claim 2 in which said external attachment means comprise welds between the outside walls of said center sill and said respective portions of said sill side castings which project through said openings in said center sill.

4. The invention according to claim 3 in which at least one of said outside walls of said center sill and said projecting portion of said sill side castings is chamfered to provide for a groove-type weld.

5. The invention according to claim 2 in which said external attachment means comprise welds between the outside walls of said center sill and said respective portions of said sill side castings which project outwardly from said outside walls through said openings in said center sill.

6. The invention according to claim 1 in which said arcuate recess is in alignment with and adjacent to said open end of said slot in said sill side castings.

7. The invention according to claim 1 in which said center sill reinforcement means further comprise reinforcement plates which are secured to said center sill, said reinforcement plates located proximate the outside surfaces of respective side walls of said center sill on opposite sides of said coupler member, each of said reinforcement plates having an aperture aligned with said openings in said center sill through which said portion of said sill side castings project, each of said reinforcement plates further including an arcuate recess for receiving a corresponding shaped edge of said draft key, said reinforcement plates thereby transferring the longitudinal draft loads of said coupler member from said draft key to said center sill.

8. The invention according to claim 7 in which said arcuate recess is in parallel alignment with a vertical striker member.

9. The invention according to claim 7 in which said arcuate recess is in alignment with and adjacent to said open end of said slot in said sill side casting.

10. The invention of claim 7 in which said reinforcement plates are secured to said center sill with welds between the outside walls of said center sill and the outer periphery of said respective reinforcement plates.

11. The invention according to claim 7 in which said sill side casting is attached to said reinforcement plate with a weld about said projecting portion of said sill side casting at the outer periphery of said aperture in said reinforcement plate.

* * * * *